US005289175A

United States Patent [19]

Kawagishi

[11] Patent Number: 5,289,175

[45] Date of Patent: Feb. 22, 1994

[54] METHOD OF AND APPARATUS FOR DRIVING FERROELECTRIC LIQUID CRYSTAL DISPLAY DEVICE

[75] Inventor: Hideyuki Kawagishi, Fujisawa, Japan

[73] Assignee: Canon Kabushiki Kaisha, Tokyo, Japan

[21] Appl. No.: 942,130

[22] Filed: Sep. 8, 1992

Related U.S. Application Data

[63] Continuation of Ser. No. 503,772, Apr. 3, 1990, abandoned.

[30] Foreign Application Priority Data

Apr. 3, 1989 [JP] Japan ..... 1-81546

[51] Int. Cl.[5] ..... G09G 3/36

[52] U.S. Cl. ..... 345/97; 359/56; 359/84; 345/212

[58] Field of Search ..... 340/765, 784, 811, 813, 340/814; 359/55, 56, 84

[56] References Cited

U.S. PATENT DOCUMENTS 4,709,995 12/1987 Kuribayashi et al. .
4,778,260 10/1988 Okada et al. .
4,800,382 1/1989 Okada et al. ..... 340/784
4,836,656 6/1989 Mouri et al. .
4,870,398 9/1989 Bos ..... 350/333 X
4,901,066 2/1990 Kobayashi et al. ..... 340/784 X
4,915,477 4/1990 Ohta et al. ..... 350/333
4,925,277 5/1990 Inaba ..... 350/333 X
4,932,759 6/1990 Toyono et al. ..... 350/333 X
5,010,326 4/1991 Yamazaki et al. ..... 350/333 X

*Primary Examiner*—Ulysses Weldon
*Attorney, Agent, or Firm*—Fitzpatrick, Cella, Harper & Scinto

[57] ABSTRACT

A method and an apparatus of driving a ferroelectric liquid crystal display device are provided having N scanning electrodes, and M data electrodes arranged in the form of an N×M matrix, N and M being positive integers, and a pixel being formed at each intersection of the scanning electrodes and the data electrodes of the matrix. The method comprises the step of applying a selected scanning signal to a Kth selected scanning electrode in a time period, wherein K is a positive integer and K≦N. A selected data signal is applied to a data electrode in the time period to form a synthetic voltage at a selected pixel, and an auxiliary signal voltage is applied to a (K−A) scanning electrode in the time period, wherein A is a positive integer and 1<A<N.

24 Claims, 6 Drawing Sheets

EXAMPLE OF TIME CHART

SYNTHETIC VOLTAGE APPLIED

FIG. 2 (a) PRIOR ART
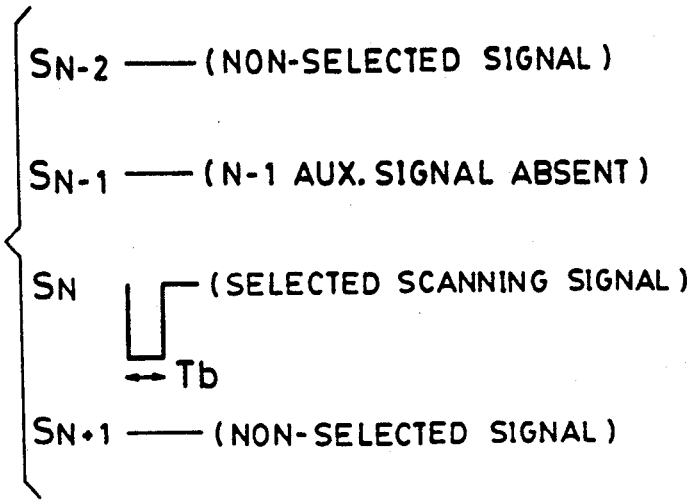
FIG. 2 (b) PRIOR ART
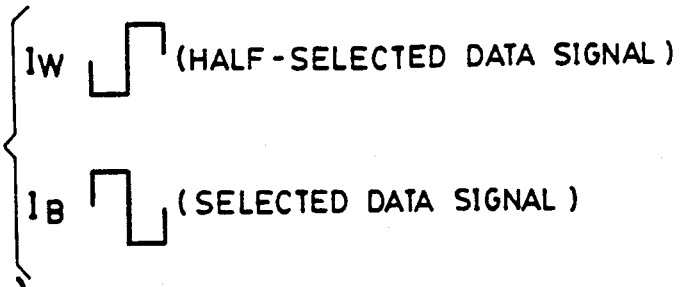
FIG. 2 (c) PRIOR ART
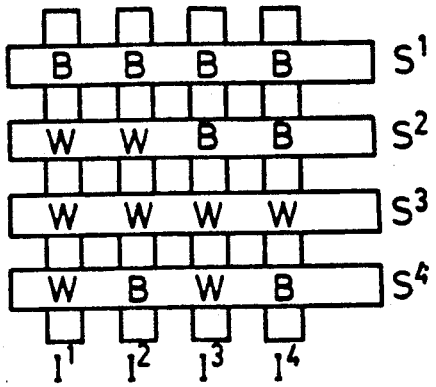

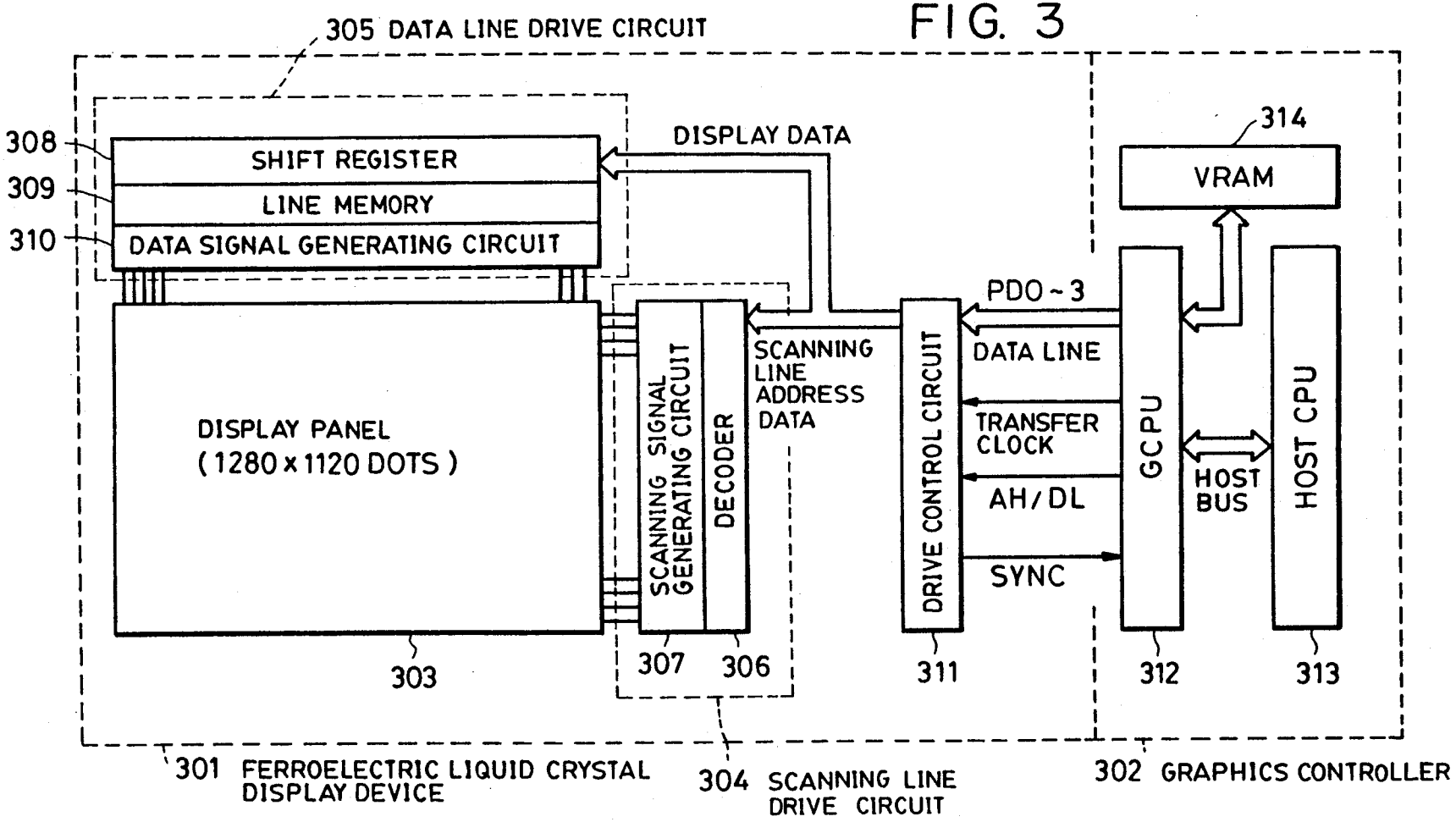
FIG. 3
VRAM
314
HOST CPU
313
HOST BUS
GCPU
312
302 GRAPHICS CONTROLLER
PDO~3
DATA LINE
TRANSFER CLOCK
AH/DL
SYNC
DRIVE CONTROL CIRCUIT
311
DISPLAY DATA
SCANNING LINE ADDRESS DATA
DECODER
306
SCANNING SIGNAL GENERATING CIRCUIT
307
304 SCANNING LINE DRIVE CIRCUIT
305 DATA LINE DRIVE CIRCUIT
SHIFT REGISTER
LINE MEMORY
DATA SIGNAL GENERATING CIRCUIT
DISPLAY PANEL (1280 x 1120 DOTS)
303
301 FERROELECTRIC LIQUID CRYSTAL DISPLAY DEVICE
308
309
310

METHOD OF AND APPARATUS FOR DRIVING FERROELECTRIC LIQUID CRYSTAL DISPLAY DEVICE

This application is a continuation of application Ser. No. 07/503,772 filed Apr. 3, 1990, now abandoned.

BACKGROUND OF THE INVENTION

1. Field of the Invention

The present invention relates to a method of driving a display device such as a ferroelectric liquid crystal. The invention also relates to a driving control apparatus for driving and controlling such a ferroelectric liquid crystal display apparatus.

2. Description of the Related Art

In recent years, rapid progress has been made in the development of ferroelectric liquid crystal devices which are to be used in place of conventional nematic liquid crystal devices. Briefly, a ferroelectric liquid crystal device employs a pair of substrates spaced by a distance which is small enough to enable control of the spiral arrangement of liquid crystal molecules in a chiral smectic C phase of a bulk state, e.g., in the form of a thin cell having a thickness of 1 to 2 μm. The liquid crystal molecules are arranged between these substrates and, in addition, vertical molecule layers each composed of a plurality of liquid crystal molecules are arranged unidirectionally. Ferroelectric liquid crystal devices are generally superior both in memory characteristics and response speed and, hence, are expected to enable development of large-size display apparatuses having such superior characteristics.

Thus, it has been proposed to produce a display device having a large display area presented by ferroelectric display element with scanning and data electrodes arranged in a matrix form. Production of such a large-size ferroelectric liquid crystal display device, however, is encountered with the following problems. Namely, a drivable region tends to be extremely restricted or, in the worst case, completely extinguished due to change in the ambient temperature or local temperature difference in the cell, with the result that the display panel cannot display information. Expansion of the drivable region is therefore an important object in the development of ferroelectric liquid crystal display device. In addition, minimization of the time required for forming one picture frame is still an important object, from a view point of display speed.

SUMMARY OF THE INVENTION

Accordingly, an object of the present invention is to provide a method of driving a ferroelectric liquid crystal display device, as well as an apparatus for driving and controlling a ferroelectric liquid crystal display device, capable of widening the drivable region of the ferroelectric liquid crystal display device so as to enable the whole area of a display panel to display information despite any change in temperature, without causing any prolongation in the time required for forming one picture frame as compared with known liquid crystal display devices, thereby overcoming the above-described problems of the prior art.

To this end, according to one aspect of the present invention, there is provided a method of driving a ferroelectric liquid crystal display device having N scanning electrodes, and M data electrodes arranged in the form of an N×M matrix, N and M being positive integers, and a pixel being formed at each intersection of the scanning electrodes and the data electrodes of the matrix. The method comprises the step of applying a selected scanning signal to a Kth selected scanning electrode in a time period, wherein K is a positive integer and $K \leqq N$. A selected data signal is applied to a data electrode in the time period to form a synthetic voltage at a selected pixel, and an auxiliary signal voltage is applied to a (K−A) scanning electrode in the time period, wherein A is a positive integer and $1<A<N$, preferably A is equal to 2.

According to another aspect of the invention, there is provided a method of driving a ferroelectric liquid crystal display device having N scanning electrodes, and M data electrodes in the form of an N×M matrix, N and M being positive integers, and a pixel being formed at each intersection of the scanning electrodes and the data electrodes of the matrix. The method comprises the step of applying a selected scanning signal of a first frequency to a Kth selected scanning electrode line in a time period, wherein K is a positive integer and $K \leqq N$. A selected data signal is applied to a data electrodes in the time period to form a synthetic voltage at a selected pixel, and an auxiliary signal voltage of the frequency is applied to a (K−A) scanning electrode in the time period, wherein A is a positive integer and $A<N$, preferably A is equal to 1.

According to this method, it is possible to reduce the maximum crosstalk, as will be fully described later.

The above and other objects, features and advantages of the present invention will become clear from the following description of the preferred embodiments taken in conjunction with the accompanying drawings.

BRIEF DESCRIPTION OF THE DRAWINGS

FIG. 3 is a block diagram of an apparatus embodying the present invention.

DESCRIPTION OF THE PREFERRED EMBODIMENT

Preferred embodiments of the present invention will be described with reference to the accompanying drawings.

Figure 1:
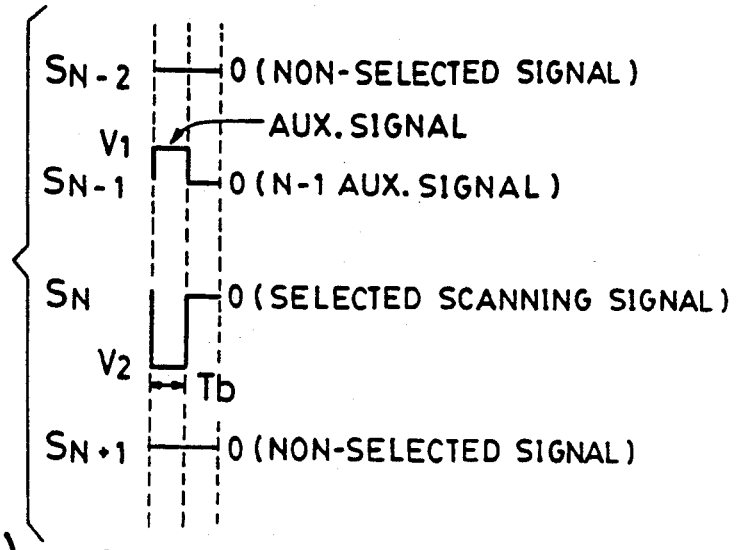
FIGS. 1(*a*) to 1(*e*) are timing of signals employed in an embodiment of the method of the present invention for driving a ferroelectric liquid crystal display device.
Figure 1:
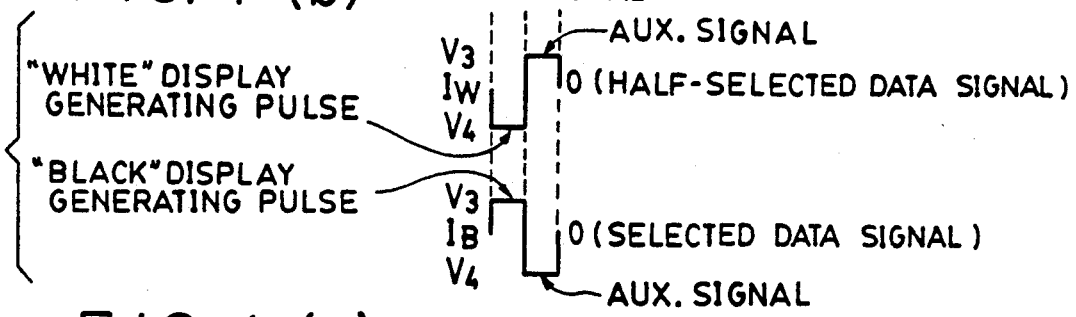
Figure 1:
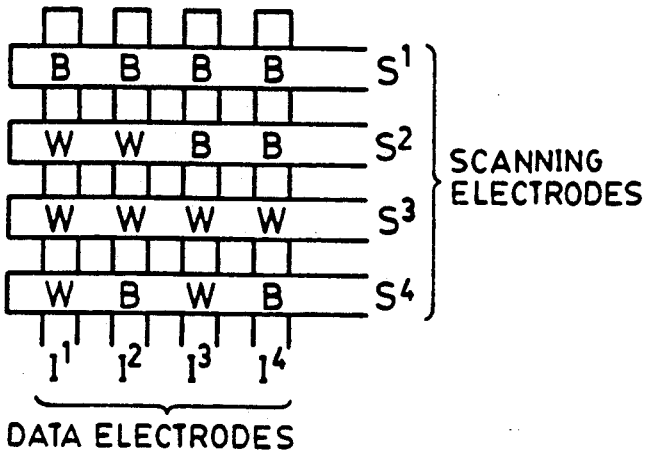
Figure 1:
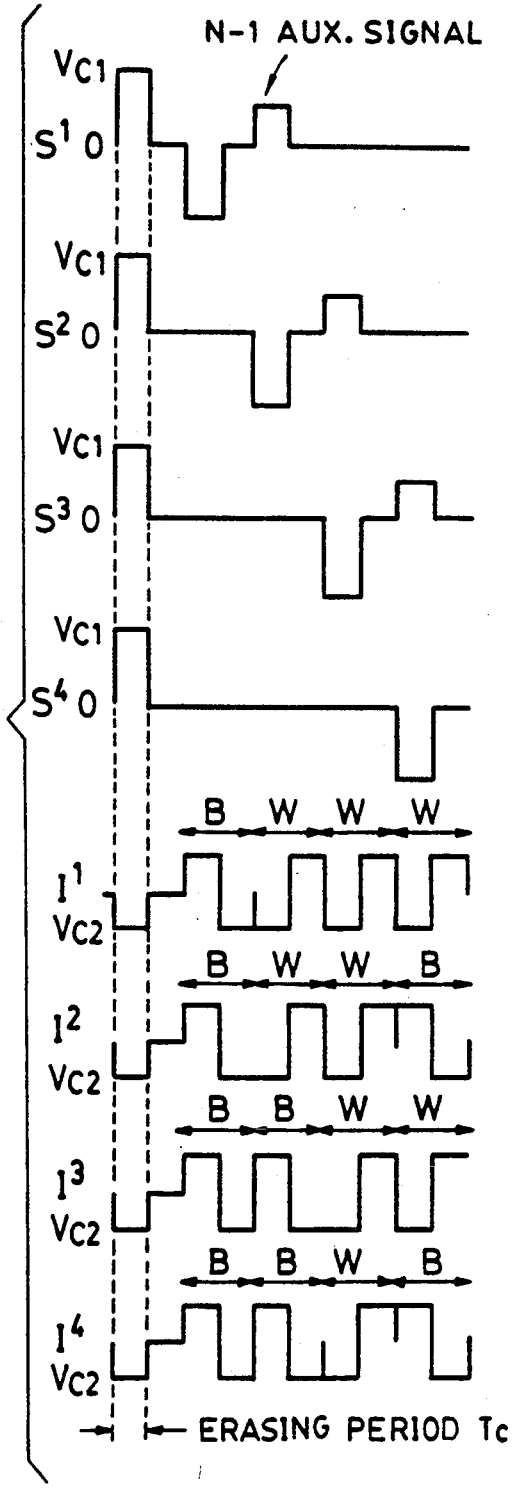
Figure 1:
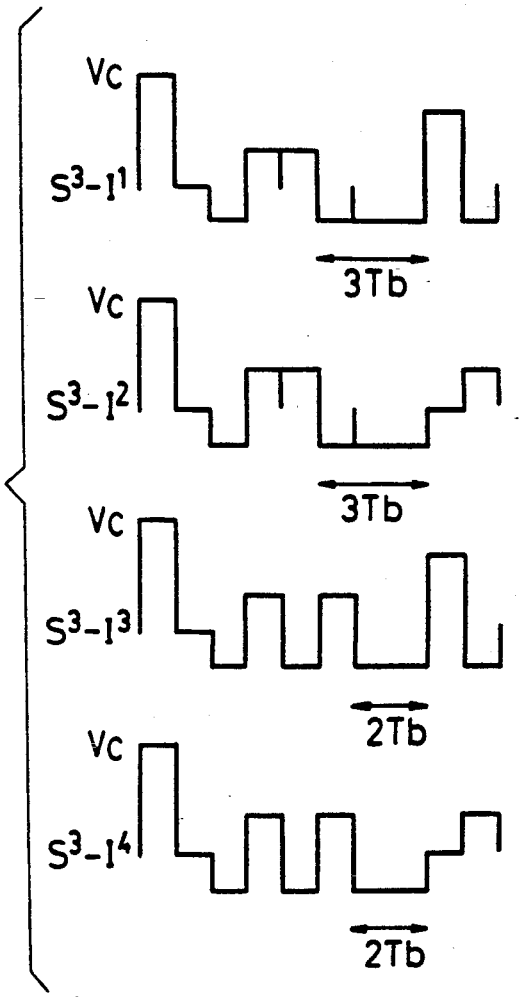

FIGS. 1(*a*) to 1(*e*) are timing charts showing waveforms of signals employed in an embodiment of the method of the invention for driving a ferroelectric liquid crystal display device, wherein FIG. 1(*a*) shows the waveform of a scanning signal, while FIG. 1(*b*) shows the waveform of data signal.

More specifically, $S_N$ appearing in FIG. 1(*a*) represents a selected scan signal applied to the scanning electrode which is selected in an N-th selecting operation as counted from the beginning, while $S_{N-1}$ represents an auxiliary signal which is applied to the scanning electrode selected in the (N−1)th scanning operation in the period of application of the selected scanning signal $S_N$ to the scanning electrode selected in the N-th selecting operation. This auxiliary signal will be referred to as "(N−1) auxiliary signal" hereinafter. $S_{N-2}$ and $S_{N+1}$ represent, by way of examples, waveforms of non-selected signals applied to the scanning electrodes which are not in receipt of the selected scanning signal $S_N$ nor the (N−1) auxiliary signal $S_{N-1}$. $T_b$ represents the pulse width of the selected scanning signal $S_N$.

Referring now to FIG. 1(*b*), $I_W$ represents a half-selected data signal which in this case is assumed to be a white signal, whereas Is shows the waveform of a selected data signal which in this case is assumed to be a black signal.

The half-selected data signal $I_W$ having a white display generating pulse $V_4$ synchronizes with a pulse $V_2$ of the scanning selection signal $S_N$. A synthetic voltage formed by the white display generating pulse $V_4$ and the pulse $V_2$ effects writing of white display in the selected pixel. On the other hand, the selected data signal $I_B$ having a black display generating pulse V synchronizes with the pulse $V_2$ of the scanning selection signal $S_N$. A synthetic voltage formed of the black display generating pulse V and the pulse $V_2$ effects writing of black display on the selected pixel.

The half-selected data signal $I_W$ and the selected data signal $I_B$ respectively have auxiliary signals on the later half parts thereof. These auxiliary signals added to the data signals are described in, for example, the specifications of the U.S. Pat. Nos. 4,655,561, 4,638,310 and 4,715,688. U.S. Pat. No. 4,701,026 described auxiliary signals added to the scanning signals. The entire disclosures of each of those patents are incorporated herein by reference.

The height or level of the pulse $V_1$ of the (N−1) auxiliary signal is determined to be not greater than that of the pulse $V_2$ of the select scanning signal. In the described embodiment, these pulse amplitudes are determined to meet the condition of $2\cdot|V_1|=|V_2|$. Preferably, the pulse $V_1$ and $V_2$ have opposite polarities from each other. The auxiliary signal added to the half-selected data signal $I_W$ has a polarity opposite to that of the white display generating pulse. Similarly, the auxiliary signal added to the selected data signal $I_B$ has a polarity opposite to that of the black display generating pulse.

According to the method of the present invention, a pixel on the N-th scanning electrode receives the synthetic voltages $S_N-I_W$ or $S_N-I_B$ formed of the data signal $I_W$ or $I_B$ corresponding to a desired image signal and the select scanning signal $S_N$ and, in the period in which the above-mentioned pixel is in receipt of such a synthetic voltage, the auxiliary scan signal voltage $S_{N-1}$ is applied to the (N−1)th scanning electrode.

FIG. 1(*c*) shows an example of a display on a ferroelectric liquid crystal display device having electrodes arranged in a matrix of four lines and four columns (4×4 matrix) More specifically, this display device has four scanning electrodes $S^1$ to $S^4$ and four data electrodes $I^1$ to $I^4$. Symbols B and W appearing on points where the scanning electrodes $S^1$ to $S^4$ and the data electrode $I^1$ to $I^4$ represent the contents of the display. More specifically, B represents a display in black and W represent a display in white.

FIG. 1(*d*) shows timing charts illustrating voltages applied to the scanning electrode $S^1$ to $S^4$ and the data electrode $I^1$ to $I^4$ of the electrode matrix carrying the display pattern as shown in FIG. 1(*c*), in a period of scanning over one frame following a period $T_c$ of erasure of the display to the white state. In the timing charts showing the voltages applied to the data electrode $I^1$ to $I^4$, symbol B and W are used to represent the contents of the display, i.e., black display and white display, respectively, in the respective pulse durations. In the erasing period $T_c$, voltages $V_{c1}$ and $V_{c2}$ are respectively applied to the scanning electrodes and the data electrodes so that the synthetic voltage formed on these two voltages $V_{c1}$ and $V_{c2}$ is applied to the pixels on the points of intersection between these two electrodes, whereby the pixels are turned off into the white state.

FIG. 1(*e*) shows the synthetic voltage $S^3-I^j$ (j being 1 to 4) applied to the pixel on the scanning electrode $S^3$ of the matrix shown in FIG. 1(*c*). The pulse width of the widest pulse signal which takes part in the crosstalk, in terms of a multiple of the pulse width $T_b$ of the selected scanning signal $S_N$, will be referred to as "maximum crosstalk amount" hereinafter. In the display example shown in FIG. 1(*c*), the maximum crosstalk takes place in the case where a certain pixel is to be turned to white W. This pixel has been in receipt of the half-selected data signal $I_w$. In this case, the maximum crosstalk amount is $3T_b$, as will be understood from the waveforms $S^3-I^1$ and $S^3-I^2$.

Figure 2D:
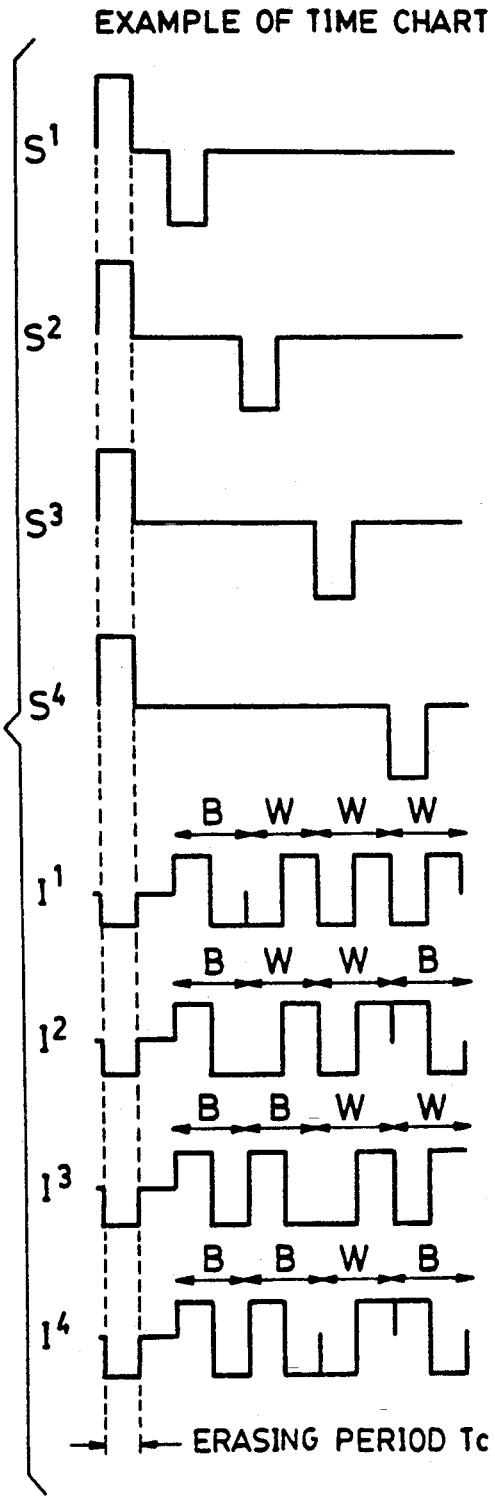
FIG. 2(d) PRIOR ART
FIGS. 2(*a*) to 2(*e*) are timing charts showing waveforms of signals used in a comparative method.
Figure 2E:
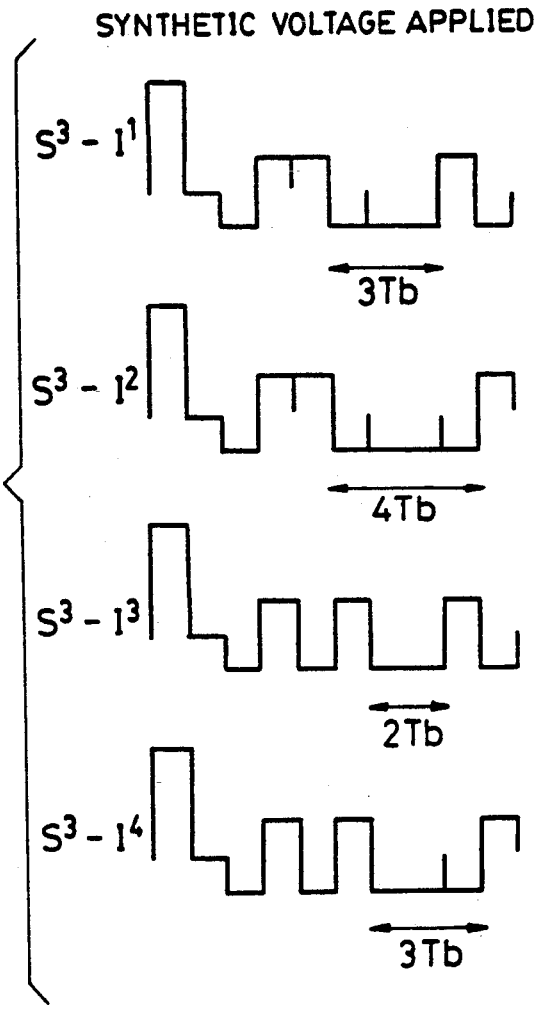
FIG. 2(e) PRIOR ART

FIGS. 2(*a*) to 2(*e*) are timing charts which show, by way of example, a known method of driving a liquid crystal display device for the purpose of comparison with the embodiment of the method of the invention described hereinbefore.

Waveforms employed in this comparative example of the driving method are substantially the same as those used in the embodiment shown in FIG. 1, except that the selected scanning signal $S_N$ is not accompanied by the (N−1) auxiliary signal, i.e., that the signal $S_{N-1}$ is a non selected scanning signal as are the oases of the signals $S_{N-2}$ and $S_{N+1}$, as will be seen from FIG. 2(*a*).

As will be seen from FIG. 2(*e*), the maximum crosstalk amount is $4T_b$ in this comparative driving method.

In general, the smaller the amount of crosstalk, the wider the drivable region. It is thus understood that the described embodiment of the driving method in accordance with the present invention provides a wider drivable region of ferroelectric liquid crystal display device as compared with the known driving method explained in connection with FIGS. 2(*a*) to 2(*e*).

In the embodiment described hereinbefore, the (N−1) auxiliary signal $S_{N-1}$ is applied to a predetermined scanning electrode in the period in which another scanning electrode is selected, so that the time required for forming one picture frame remains as short as that attained by the known driving method.

Figure 4:
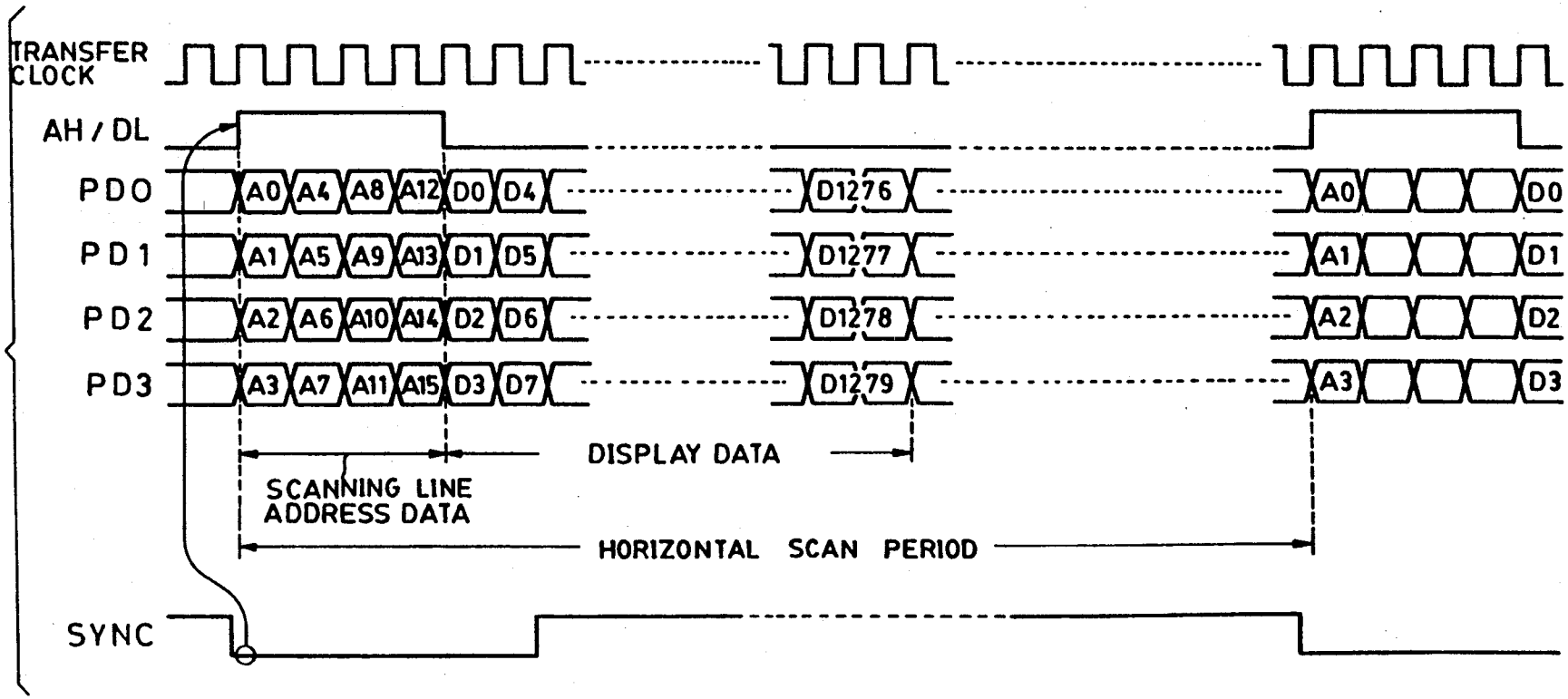
FIG. 4 is a communication timing chart.

FIG. 3 is a block diagram showing the construction of a ferroelectric liquid crystal display device 301 and a graphics controller 302 such as a personal computer which is provided on the main part of the display apparatus. The personal computer serves as a source of the data to be displayed. FIG. 4 is a communication timing chart showing the manner of the transfer of picture data. The display device 301 has a display panel 303 having an electrode matrix composed of 1120 scanning electrodes and 1280 data electrodes. The display device has a ferroelectric liquid crystal disposed in a space between a pair of orientation-treated glass sheets. The scanning electrodes are connected to a scanning line drive circuit 304, while the data electrodes are connected to a data line drive circuit 305. The scanning line drive circuit 304 and the data line drive circuit 305 in combination provide a display drive circuit 304/305.

The operation will be described with reference to FIGS. 3 and 4. The graphics controller 302 provides the display drive circuit 304/305 and data lines PD0–PD3 with scanning line address data for designating the scanning electrode and and information picture data. In this embodiment, the scanning line address data and the picture data representing the information to be displayed are transmitted through a common path, therefore it is necessary to discriminate these two kinds of data from each other. A signal AH/DL is used for the purpose of the discrimination. Namely, the AH/DL signal at "Hi" level indicates that the transmitted data is the scanning line address data, whereas, at "Lo" level, it indicates that the data is the picture data to be displayed.

The liquid crystal display device 301 includes a drive control circuit 311 which separates the scanning line address data from the successive picture data PD0–PD3 coming from the graphics controller 302. The thus separated scanning line address data are delivered to the scanning line drive circuit 304 in a timed relation to the driving of the scanning electrodes. These scanning line address data are input to a decoder 306 of the scanning line drive circuit 304 and the selected scanning electrodes on the display panel 303 are driven through the decoder 306 by a scanning signal generating circuit 307. Meanwhile, the picture data are delivered to a shift register 308 in the data line drive circuit 305 and are shifted in accordance with transfer clocks, at a pitch of four pixels per one transfer clock. When the shift is completed over one scan line, display data is obtained for each of 1280 pixels. This one-line display data is transferred to a line memory 309 and is stored therein for a period of one horizontal scan and is delivered by the data signal generating circuit 310 to the respective data electrodes as the display data signal.

In the illustrated embodiment, the driving of the display panel 303 of the liquid crystal display device 301 and the generation of the scanning line address data and display data in the graphic controller 302 are not synchronized. It is therefore necessary to synchronize the operations of both units 301 and 302 when the picture data are transferred. This synchronization is conducted by the signal SYNC which is generated by the drive control circuit 311 in the liquid crystal display device 301 for each horizontal scan period. The graphics controller 302 continuously monitors the signal SYNC and enables the transfer of the picture data when the signal SYNC is at the "Lo" level, whereas, when the SYNC signal is at the "Hi" level, it prohibits the transfer of picture data when transfer of picture data is completed with one horizontal scan line.

More specifically, referring to FIG. 4, the graphics controller 302 sets the AH/DL signal to the "Hi" level so as to start the transfer of the picture data of one horizontal scan line immediately after detection of turning of the signal SYNC to the "Lo" level. During the period of transfer of the picture data, the drive control circuit 311 in the liquid crystal display device 301 maintains the signal SYNC at the "Hi" level. When the period of one horizontal scan is over, to complete writing of one line data on the display panel, the drive control circuit 311 sets the signal SYNC to the "Lo" level so as to enable the next scan line to receive the picture data.

As has been described, according to the present invention, it is possible to enlarge or expand the drivable region of a ferroelectric liquid crystal display device without being accompanied by elongation of the time required for forming one picture frame.

Although the invention has been described through its preferred form, it is to be understood that the described embodiments are only illustrative and various changes and modifications are possible without departing from the scope of the present invention which is limited solely by the appended claims.

What is claimed is:

1. A method of driving a ferroelectric liquid crystal display device having N scanning electrodes, and M data electrodes arranged in the form of an $N \times M$ matrix, N and M being positive integers, and a pixel being formed at each intersection of the scanning electrodes and the data electrodes of the matrix, said method comprising the steps of:

applying a selected unipolar scanning signal to a Kth selected scanning electrode in a time period, wherein K is a positive integer and $K \leqq N$;

applying a selected data signal to a data electrode in the time period to form a synthetic voltage at a selected pixel;

applying an auxiliary signal voltage polarized opposite to the selected unipolar scanning signal on the basis of a non-selected scanning signal to a $(K-A)$ scanning electrode in the time period, wherein A is a positive integer and $1<A<N$; and applying a non-selected scanning signal different from the auxiliary signal voltage to each of the remaining scanning electrodes in the time period.

2. A method according to claim 1, wherein the selected scanning signal has one polarity with respect to the non-selected scanning signal, and wherein the auxiliary signal voltage has the opposite polarity with respect to the non-selected scanning signal.

3. A method according to claim 1, wherein an erasing voltage is applied to the selected pixel on the Kth scanning electrode prior to the application of the selected scanning signal.

4. A method according to claim 1, wherein an erasing voltage is applied to the pixels on the scanning electrodes of the matrix prior to the application of the selected scanning signal voltage.

5. A method according to claim 1, wherein A is equal to 2.

6. A method according to claim 1, further comprising the step of: applying an additional auxiliary signal to the data electrode, after the application of the selected data signal to the data signal corresponding to the selected

7. An apparatus for driving and controlling a ferroelectric liquid crystal display device having N scanning electrodes and M data electrodes arranged in the form of an $N \times M$ matrix, N and M being positive integers, and a pixel being formed at each intersection of the scanning electrodes of the matrix, said apparatus comprising:

first means applying a selected unipolar scanning signal to a Kth selected scanning electrode in a time period, wherein K is a positive integer and $K \leqq N$;

second means applying a selected data signal to a data electrode in the time period to from a synthetic voltage at a selected pixel;

third means for applying an auxiliary signal voltage polarized opposite to the selected unipolar scanning signal on the basis of a non-selected scanning signal to a $(K-A)$ scanning electrode in the time period, wherein A is a positive integer and $1<A<N$; and fourth means for applying a non-selected scanning signal different from the auxiliary signal voltage to each of the remaining scanning electrodes.

8. An apparatus according to claim 7, wherein the selected scanning signal has one plurality with respect to the non-selected scanning signal, and wherein said auxiliary signal voltage has the opposite polarity with respect to the non-selected scanning signal.

9. An apparatus according to claim 7, wherein an erasing voltage is applied to the selected pixel on the Kth scanning electrode prior to the application of the selected scanning signal voltage.

10. An apparatus according to claim 7, wherein an erasing voltage is applied to the pixels on the scanning electrodes of the matrix prior to the application of the selected scanning signal voltages.

11. An apparatus according to claim 7, wherein A is equal to 2.

12. An apparatus according to claim 7, further comprising: fifth means for applying an additional auxiliary signal to the data electrodes, after the application of the selected data signal to the data signal corresponding to the selected pixel.

13. A method of driving a ferroelectric liquid crystal display device having N scanning electrodes, and M data electrodes arranged in the form of an $N \times M$ matrix, N and M being positive integers, and a pixel being formed at each intersection of the scanning electrodes and the data electrodes of matrix, said method comprising the steps of:

applying a selected unipolar scanning signal of a first frequency to a Kth selected scanning electrode line in a time period, wherein K is a positive integer and $K<N$;

applying a selected data signal to a data electrode in the time period to form a synthetic voltage at a selected pixel;

applying an auxiliary signal voltage polarized opposite to the selected unipolar scanning signal on the basis of a non-selected scanning signal of the frequency to a $(K-A)$ scanning electrode in the time period, wherein A is a positive integer and $A<N$; and applying a non-selected scanning signal different from the auxiliary signal voltage to each of the remaining scanning electrodes.

14. A method according to claim 13, wherein the selected scanning signal has one polarity with respect to the non-selected scanning signal, and wherein the auxiliary signal voltage has the opposite polarity with respect to the non-selected scanning signal.

15. A method according to claim 13, wherein an erasing voltage is applied to the selected pixel on the Kth scanning electrode prior to the application of the selected scanning signal.

16. A method according to claim 13, wherein an erasing voltage is applied to the pixels on the scanning electrodes of the matrix prior to the application of the selected scanning signal voltage.

17. A method according to claim 13, wherein A is equal to 1.

18. A method according to claim 13, further comprising the step of: applying an additional auxiliary signal to the data electrodes, after the application of the selected data signal to the data signal corresponding to the selected pixel.

19. An apparatus for driving and controlling a ferroelectric liquid crystal display device having N scanning electrodes and M data electrodes arranged in the form of an $N \times M$ matrix, N and M being positive integers, and a pixel being formed at each intersection of the scanning electrodes of the matrix, said apparatus comprising:

first means applying a selected unipolar scanning signal of a frequency to a Kth selected scanning electrode in a time period, wherein K is a positive integer and $K<N$;

second means applying a selected data signal to a data electrode in the time period to form a synthetic voltage at a selected pixel;

third means for applying an auxiliary signal voltage polarized opposite to the selected unipolar scanning signal on the basis of a non-selected scanning signal of the frequency to a $(K-A)$ scanning electrode in the time period, wherein A is a positive integer and $A<N$; and fourth means for applying a non-selected scanning signal different from the auxiliary signal voltage to each of the remaining electrodes.

20. An apparatus according to claim 19, wherein the selected scanning signal has one polarity with respect to the non-selected scanning signal, and wherein said auxiliary signal voltage has the opposite polarity with respect to the non-selected scanning signal.

21. An apparatus according to claim 19, wherein an erasing voltage is applied to the selected pixel on the Kth scanning electrode prior to the application of the selected scanning signal voltage;

22. An apparatus according to claim 19, wherein an erasing voltage is applied to the pixels on the scanning electrodes of the matrix prior to the application of the selected scanning signal voltage.

23. An apparatus according to claim 19, wherein A is equal to 1.

24. An apparatus according to claim 19, further comprising fifth means for applying an additional auxiliary signal to the data electrodes, after the application of the selected data signal to the data signal corresponding to the selected pixel.

* * * * *

UNITED STATES PATENT AND TRADEMARK OFFICE

CERTIFICATE OF CORRECTION

PATENT NO. : 5,289,175

DATED : February 22, 1994

INVENTOR(S) : HIDEYUKI KAWAGISHI

It is certified that error appears in the above-identified patent and that said Letters Patent is hereby corrected as shown below:

ON TITLE PAGE

In [56] References, under U.S. PATENT DOCUMENTS, insert:

--4,638,310 1/1987 Ayliffe ..... 340/805
4,655,561 4/1987 Kanbe et al. ..... 350/350
4,701,026 10/1987 Yazaki et al. ..... 350/333
4,715,668 12/1987 Harada et al. ..... 350/350--.

COLUMN 2

Line 36, "timing of" should read --timing charts showing waveforms of--.

COLUMN 3

Line 5, "Is" should read --$I_B$--.
Line 14, "V synchronizes" should read --$V_3$ synchronizes--.
Line 17, "V and" should read --$V_3$ and--.
Line 65, "symbol" should read --symbols--.

COLUMN 4

Line 30, "non selected" should read --non-selected-- and "oases" should read --cases--.

COLUMN 6

Line 5, "electrodes," should read --electrodes--.
Line 41, "of:" should read --of--.
Line 43, "selected" should read --selected pixel.--.
Line 56, "from" should read --form--.
Line 68, "plurality" should read --polarity--.

--

UNITED STATES PATENT AND TRADEMARK OFFICE

CERTIFICATE OF CORRECTION

PATENT NO. : 5,289,175

DATED : February 22, 1994

INVENTOR(S) : HIDEYUKI KAWAGISHI

It is certified that error appears in the above-identified patent and that said Letters Patent is hereby corrected as shown below:

COLUMN 7

Line 15, "prising:" should read --prising--.

COLUMN 8

Line 6, "of:" should read --of--.
Line 7, "electrodes," should read --electrodes--.
Line 41, "voltage;" should read --voltage.--.

Signed and Sealed this

Tenth Day of January, 1995

Bruce Lehman

*Attest:*

BRUCE LEHMAN

*Attesting Officer*

*Commissioner of Patents and Trademarks*

--